United States Patent [19]

Ikeda et al.

[11] Patent Number: 5,009,574

[45] Date of Patent: Apr. 23, 1991

[54] THRUST BEARING AND SHOE LUBRICATOR FOR A SWASH PLATE TYPE COMPRESSOR

[75] Inventors: Hayato Ikeda; Masahiro Sawada; Norihiko Nakamura, all of Kariya, Japan

[73] Assignee: Kabushiki Kaisha Toyoda Jidoshokki Seisakusho, Aichi, Japan

[21] Appl. No.: 445,289

[22] Filed: Dec. 4, 1989

[30] Foreign Application Priority Data

Dec. 2, 1988 [JP] Japan ..... 63-306369

[51] Int. Cl.[5] ..... F04B 1/16

[52] U.S. Cl. ..... 417/222; 417/270; 91/506

[58] Field of Search ..... 417/222, 269, 270; 92/12.2; 91/506

[56] References Cited

U.S. PATENT DOCUMENTS 4,297,085 10/1981 Brucken ..... 417/222
4,299,543 11/1981 Shibuya ..... 417/269
4,781,539 11/1988 Ikeda et al. ..... 417/269

*Primary Examiner*—Leonard E. Smith
*Assistant Examiner*—John A. Savio, III
*Attorney, Agent, or Firm*—Burgess, Ryan & Wayne

[57] ABSTRACT

A swash plate type compressor having a pair of axially combined front and rear cylinder blocks forming therein a plurality of cylinder bores, a swash plate chamber, and an oil chamber in which a lubricating oil is stored to be stirred by a swash plate rotatably received in the swash plate chamber, a drive shaft centrally rotatably mounted in the combined cylinder blocks to cause a rotation of the swash plate, a plurality of reciprocatory double-headed pistons slidably fitted in the cylinder bores and operatively engaged with the swash plate via shoe members to be reciprocated by the rotation of the swash plate, a pair of thrust bearings axially supporting the swash plate, front and rear housings having suction chambers for the refrigerant gas before compression and discharge chambers for the refrigerant gas after compression, the front housing further having a shaft sealing chamber formed therein and separated from the suction chamber thereof to define an intermediate pressure chamber between the high pressure swash plate chamber and the low pressure suction chamber of the front housing, a thin fluid passageway interconnecting the shaft sealing chamber with the suction chamber. The intermediate pressure chamber and the thin fluid passageway prevent evacuation of the lubricating oil from the swash plate chamber to the suction chamber even during the rotation of the compressor at a high speed, to thereby promote a lubrication of the thrust bearings, the shoes, and the swash plate.

5 Claims, 4 Drawing Sheets

THRUST BEARING AND SHOE LUBRICATOR FOR A SWASH PLATE TYPE COMPRESSOR

BACKGROUND OF THE INVENTION

1. Field of the Invention

The present invention relates to a swash-plate operated type reciprocatory piston type compressor (hereinafter referred to as a swash plate type compressor) for use in air-conditioning systems for vehicles, and in particular, to an improved movable element lubricator incorporated into a swash plate type compressor for lubricating internal movable elements of the compressor, mainly thrust bearings, shoes, and swash plate, with a sufficient amount of lubricating oil even when the compressor is operated at a high speed.

2. Description of the Related Art

A typical swash plate type compressor as disclosed in, for example, U.S. Pat. No. 4,781,539 to Ikeda et al, is provided with a pair of horizontal axially aligned front and rear cylinder blocks which form a combined cylinder block, and the combined cylinder block is closed at both ends by front and rear housings, via valve plates. The front and rear housings form refrigerant suction chambers and refrigerant discharge chambers, and inside the combined cylinder block are formed a plurality of cylinder bores arranged around a central axis of the combined cylinder block and having axes in parallel with the central axis. Each of the cylinder bores is interconnected to the suction and discharge chambers of the front and rear housings. The combined cylinder block also has a centrally longitudinal bore formed therein, a drive shaft rotatably mounted therein via radial bearings, and a swash plate chamber in which a swash plate keyed on the drive shaft is rotatably received. The swash plate rotates with the drive shaft and is operatively engaged with double-headed pistons slidably fitted in the cylinder bores, to reciprocate the pistons across the swash plate chamber, i.e., shoes are arranged between the swash plate and the double-headed pistons to provide an universal coupling therebetween and to cause a reciprocatory compressing motion of the pistons within the cylinder bores in response to the rotation of the swash plate. Further, a pair of thrust bearings are arranged between axially opposite ends of the swash plate and the front and rear cylinder blocks to receive a thrust force acting on the swash plate as a reaction imposed by the reciprocatory motion of the pistons. Note, the reciprocatory pistons, the swash plate, the shoes, the thrust bearings, and the radial bearings are internal movable elements of the swash plate type compressor, and must be sufficiently lubricated by the lubricating oil. U.S. Pat. No. 4,781,539 discloses an example of a movable element lubricator, for a swash plate type compressor, incorporated in the swash plate type compressor for mainly lubricating the shoes and the swash plate of the compressor.

This swash plate type compressor is provided with a refrigerant circuit formed therein for introducing a refrigerant gas to be compressed from the air-conditioning circuit into the cylinder bores via the suction chambers, and for delivering a compressed refrigerant gas from the cylinder bores to the air-conditioning circuit via the discharge chambers, i.e., the refrigerant circuit includes a refrigerant circuit portion on the suction side, and a refrigerant circuit portion on the delivery side.

FIG. 6 illustrates another typical swash plate type compressor having front and rear cylinder blocks 1 and 2 axially combined and closed at both ends by front and rear housings 5 and 6, via valve plates 3 and 4. The front and rear cylinder blocks 1 and 2, and the front and rear housings 5 and 6 are axially combined together by an appropriate number of lengthy screw bolts (not illustrated in FIG. 6). The combined cylinder blocks are provided, at an axially central portion thereof, with a swash plate chamber 8 in which a swash plate 10 is received to be keyed on a drive shaft 9 rotatably mounted in centrally longitudinal coaxial bores 1*a* and 2*a* of the combined cylinder blocks 1 and 2, via a pair of front and rear radial bearings 22. A pair of thrust bearings 11 are arranged between opposite ends of boss 10*a* of the swash plate 10 and the inner ends of the front and rear cylinder blocks 1 and 2 to receive a thrust force acting on the swash plate 10 when the swash plate 10 rotates with the drive shaft 9 to reciprocate a plurality of double-headed pistons 13 within respective axial cylinder bores 12 of the combined cylinder blocks 1 and 2. The swash plate 10 is operatively engaged with the pistons 13 via shoes 14. The reciprocation of the double-headed pistons 13 compresses a refrigerant gas, and discharges the compressed refrigerant gas to be delivered from the compressor toward an air-conditioning circuit of a vehicle. The compressor of FIG. 6 is also provided with an oil pump 15 disposed inside the rear housing 6 and driven by the drive shaft 9, to thereby provide the thrust bearings 11 and the shoes 14 with a required amount of lubricating oil. That is, the lubricating oil is pumped out of an oil chamber 16 formed below the swash plate chamber 18 of the combined cylinder blocks 1 and 2, and supplied to a pump chamber 19 in the rear housing via an oil supply pipe 17 and an oil passage 18 formed in the rear valve plate 4. The lubricating oil is distributed from the pump chamber 19 to the thrust bearings 11 via an oil supply passage 20 bored in the drive shaft 9. The lubricating oil distributed to the thrust bearings 11 is further distributed to the shoes 14 and the swash plate 10 during the rotation of the swash plate 10. This oil distribution type lubricator employing the oil pump 15 is often incorporated in swash plate type compressors when a strong lubrication of the internal movable elements thereof is preferred.

Further, in another conventional oil lubricator of a swash plate type compressor, a lubricating oil is changed into oil mist by the rotation of the swash plate and is circulated with the refrigerant through a refrigerant circuit in the compressor, including suction chambers, a plurality of cylinder bores, and discharge chambers, and through a swash plate chamber for receiving therein a rotatable swash plate, so that the oil mist wets and lubricates the movable elements, such as the thrust bearings and the shoes.

In the swash plate type compressor illustrated in FIG. 6, during the compressing operation of the pistons 13, a part of the refrigerant gas compressed in the cylinder bores 12 leaks into the swash plate chamber 8, and therefore, a pressure level in the swash plate chamber 8 becomes higher than a suction pressure of the refrigerant. Nevertheless, from the point of view of lubricating the internal movable elements of the compressor, the pressure level in the swash plate chamber 8 is preferably equal to that of the suction pressure of the refrigerant gas. Although the swash plate chamber 8 is fluidly communicated with the suction chambers 21 of the front and rear housings 5 and 6, this fluid communication is not sufficient for lowering a pressure differential therebetween to zero. Therefore, one or more communicating holes are formed between the swash plate chamber 8 and a suction side of the compressor including the suction chambers 21 and suction passageways permitting the refrigerant gas before compression to flow from refrigerant inlet ports of the compressor toward the suction chambers 21.

When the rotating speed of the drive shaft 9 exceeds 5,000 R.P.M during the operation of the compressor, the pressure differential between the swash plate chamber 8 and the suction side of the compressor is increased. Also, in the construction of the compressor as illustrated in FIG. 6, the communicating passages between the swash plate 8 and the suction side of the compressor are relatively short. Therefore, the refrigerant gas containing therein a large amount of lubricating oil flows from the swash plate chamber 8 toward the suction chambers 21 through the refrigerant passageways. Therefore, an amount of lubricating oil supplied by the pump 15 becomes less than that carried from the swash plate chamber 8, and accordingly, the swash plate chamber 8 and the oil chamber 16 are not supplied with enough lubricating oil (i.e., a sufficient amount of lubricating oil is not reserved in the oil chamber 16) to thereby cause a lack of lubrication of the internal movable elements. Thus, a seizing of the shoes 14 as well as wear of the internal movable elements of the compressor, such as thrust bearings 11 and the radial bearings 22, occurs, and therefore, the operation life of the swash plate type compressor is eventually shortened.

Further, as a large amount of the lubricating oil carried from the swash plate chamber 8 toward the suction chambers 21 of the front and rear housings 5 and 6 is carried into the discharge chambers 23 of the front and rear housings when the refrigerant gas after compression is discharged into the discharge chambers 23, the lubricating oil is eventually delivered into the air-conditioning circuit connected to the swash plate type compressor, and therefore, the lubricating oil adheres to the outer surface of an evaporator of the air-conditioning circuit and adversely affects the operation of the evaporator.

In the case of the afore-mentioned conventional oil mist lubricator incorporated in the swash plate type compressors not employing an oil pump, when the lubricating oil together with the compressed refrigerant gas is delivered from the discharge chambers of the compressor into the air-conditioning circuit, the oil is separated from the compressed refrigerant gas by an oil filter, and the separated oil is returned to the suction side of the compressor to thereby prevent the lubricating oil from flowing into the air-conditioning circuit. Nevertheless, the filtering by the oil filter is often incomplete, and therefore, a considerable amount of the lubricating oil is directly delivered into the air-conditioning circuit with the compressed refrigerant gas, to adversely affect the operation of the evaporator and shorten the operating life of the air-conditioning circuit.

SUMMARY OF THE INVENTION

Therefore, an object of the present invention is to obviate the above-mentioned lubrication problems encountered by the conventional swash plate type compressor.

Another object of the present invention is to provide a movable element lubricator for a swash plate type compressor, capable of preventing a flow of a lubricating oil toward a refrigerant circuit inside the compressor during a rotation of the compressor at a high speed.

A further object of the present invention is to provide a swash plate type compressor in which lubrication of the internal movable elements of the compressor, mainly thrust bearings, shoes, and swash plate can be constantly maintained while the compressor is in operation.

In accordance with the present invention, there is provided a swash plate type refrigerant gas compressor incorporated in an air-conditioning circuit for a vehicle and having: a pair of axially combined front and rear cylinder blocks having a plurality of cylinder bores formed therein, an axially extended bore for rotatably receiving a drive shaft via radial bearings seated in said axial bore, a swash plate chamber, and an oil chamber for storing a lubricating oil; the swash plate chamber and the oil chamber being interconnected with one another to permit the lubricating oil to enter the swash plate chamber;

a swash plate received in the swash plate chamber and keyed on the drive shaft to be capable of rotating with the drive shaft and stirring the lubricating oil in the swash plate chamber;

a front housing arranged at one axial end of the combined cylinder blocks via a front valve plate, and having therein a central shaft sealing chamber through which the drive shaft extends, a front suction chamber for a refrigerant gas before compression, and a front discharge chamber for a refrigerant gas after compression; the shaft sealing chamber being fluidly interconnected with the swash plate chamber via inner gaps of the radial bearings in the axial bore of the combined cylinder block;

a rear housing arranged at the other axial end of the combined cylinder blocks via a rear valve plate, and having therein a rear suction chamber for the refrigerant gas before compression, and a discharge chamber for the refrigerant gas after compression; the rear suction chamber being fluidly interconnected to the front suction chamber, and the rear discharge chamber being fluidly interconnected to the front discharge chamber, a plurality of reciprocatory double-headed pistons slidably fitted in the cylinder bores and operatively engaged with the swash plate via shoes for carrying out a suction and compression of the refrigerant gas in said cylinder bores, and a discharge of the compressed refrigerant gas from the cylinder bores to the discharge chambers of the front and rear housings; the pistons sliding across the swash plate chamber to thereby permit a leakage of a part of the compressed refrigerant gas from the cylinder bores into the swash plate chamber while the drive and swash plate are rotating, the leakage of a part of the compressed refrigerant gas generating a high pressure condition in the swash plate chamber;

a pair of thrust bearings mounted on the drive shaft for axially supporting the swash plate against a thrust force acting on the swash plate;

a suction refrigerant circuit for permitting the refrigerant gas before compression to flow toward the cylinder bores when the refrigerant gas before compression returns from the air-conditioning circuit, the suction refrigerant gas circuit including at least the front and rear suction chambers, the cylinder bores, and a passageway interconnecting the front and rear suction chambers;

lubricating means for limiting an evacuation of the lubricating oil from the swash plate and oil chambers to the suction refrigerant circuit during the high pressure condition in the swash plate chamber to thereby promote a lubrication of movable elements including at least the thrust bearings, the shoes, and the swash plate by the lubricating oil stored in the swash plate and oil chambers when the swash plate rotates while dispersing the lubricating oil toward the movable elements, the lubricating means including:

a partition wall formed in the front housing for structurally separating the shaft sealing chamber from the suction chamber of the front housing; and a fluid passageway means for providing an appreciably small fluid communication between the shaft sealing chamber and the suction chamber of the front housing to thereby define an intermediate pressure chamber in the shaft sealing chamber disposed between the swash plate chamber and the suction refrigerant circuit during the operation of the swash plate type compressor.

DESCRIPTION OF THE DRAWINGS

The above and other objects, features and advantages of the present invention will become more apparent from the ensuing description of the embodiments of the present invention taken in conjunction with the accompanying drawings wherein.

DESCRIPTION OF THE PREFERRED EMBODIMENTS

Figure 1:
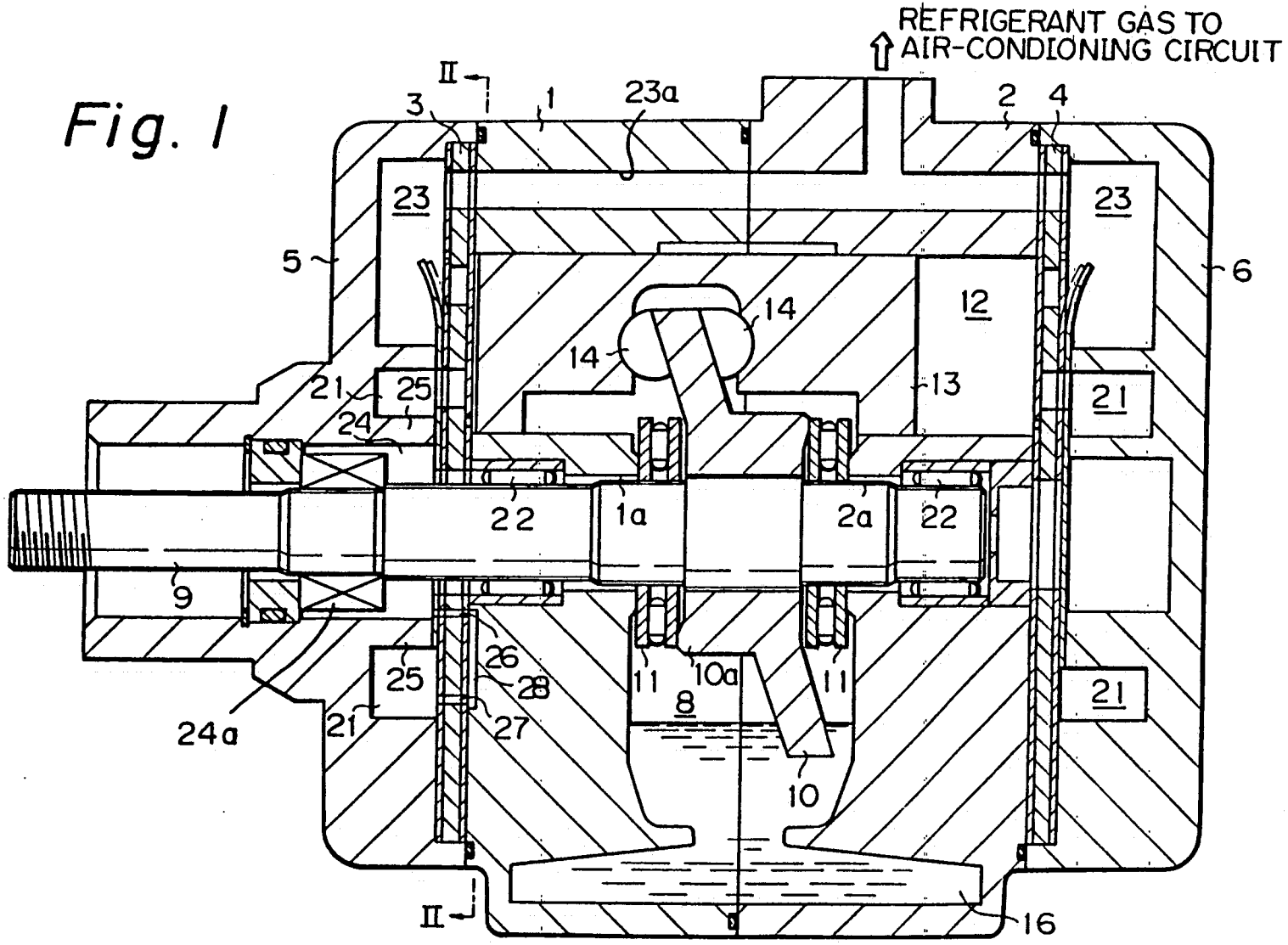
FIG. 1 is a longitudinal cross sectional view of a swash plate type compressor provided with a internal movable element lubricator according to a first embodiment of the present invention.
Figure 2:
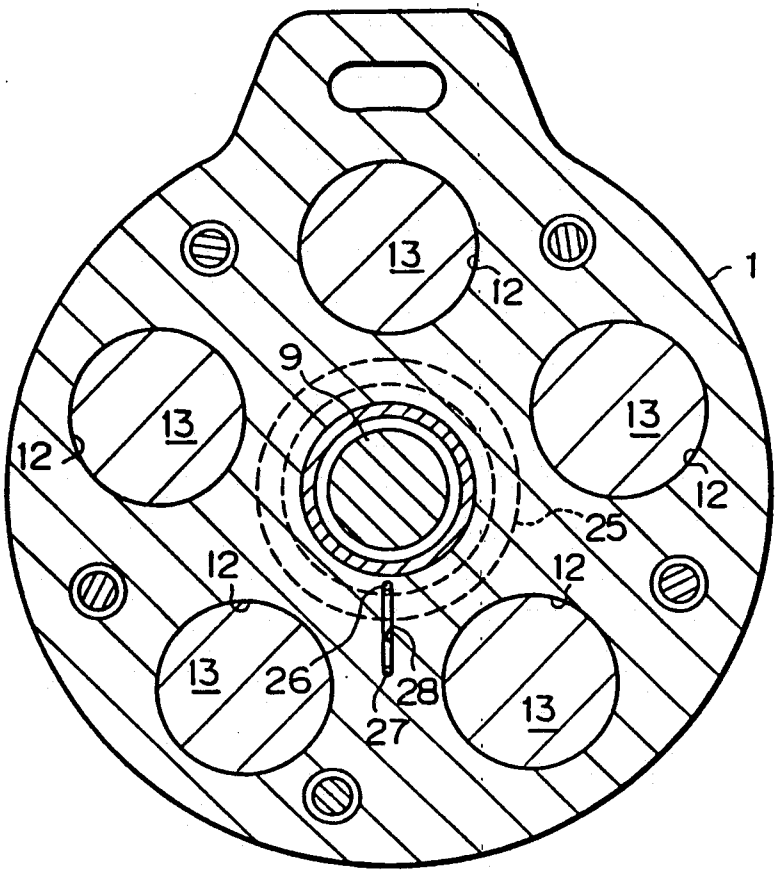
FIG. 2 is a cross-sectional view taken along the line II—II of FIG. 1.
Figure 6:
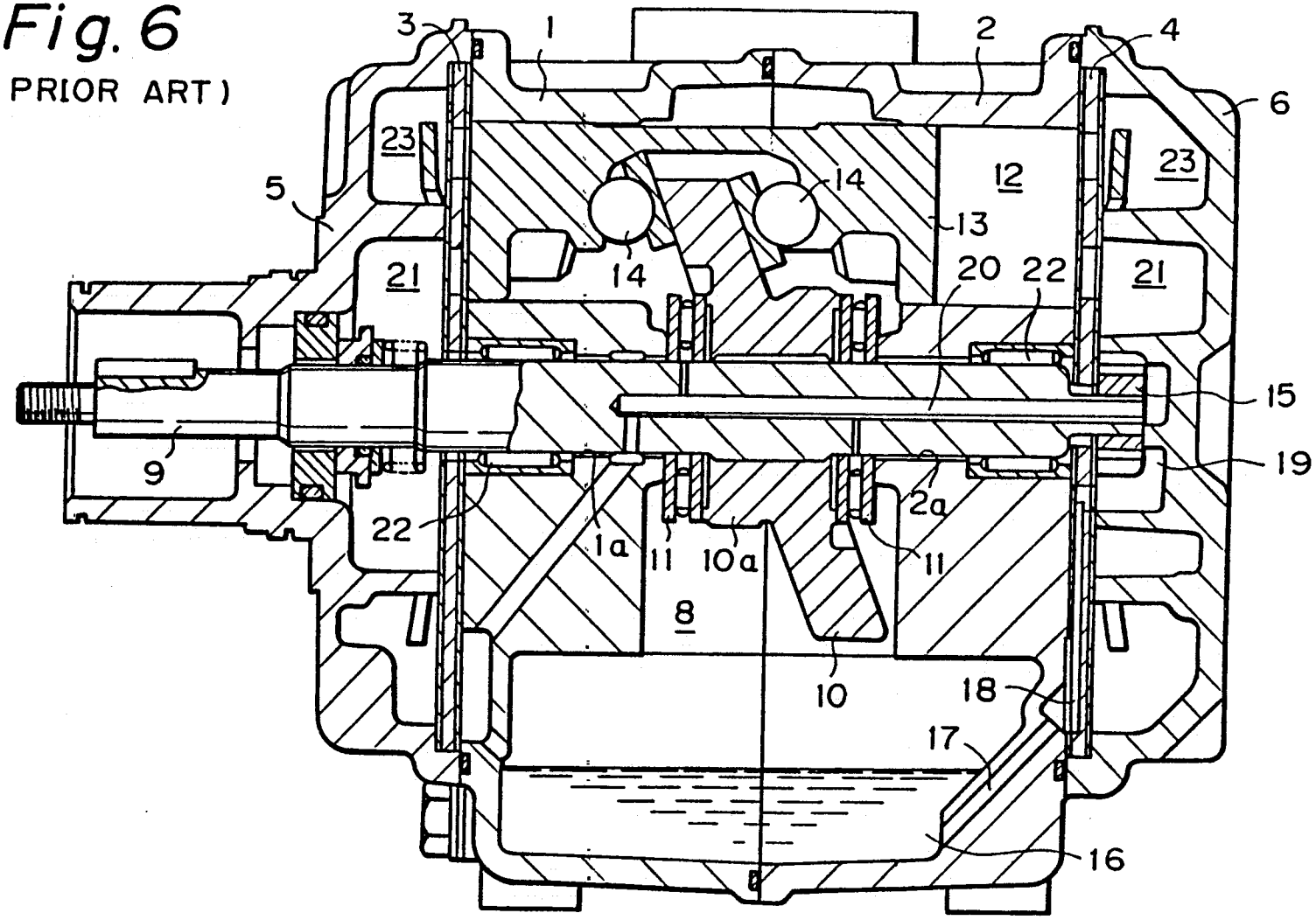
Fig. 6 (PRIOR ART)
FIG. 6 is a longitudinal cross sectional view of a swash plate type compressor according to the prior art.

Referring to FIGS. 1 and 2, a swash plate type compressor according to a first embodiment of the present invention is not provided with an oil pump in the rear housing, but is provided with an oil chamber 16 in a fluid communication with a swash plate chamber 8 for a swash plate 10. Therefore, when the swash plate 10 keyed on a horizontal drive shaft 9 is rotated, the oil reserved in the oil chamber 16 is directly stirred by the rotating swash plate 10. The stirred lubricating oil is dispersed into the space of the swash plate chamber, and lubricates internal movable elements, such as thrust bearings 11, radial bearings 22, and shoes 14. The compressor has a refrigerant circuit, i.e., the refrigerant circuit on the suction side (not shown in FIG. 1), formed therein for a refrigerant gas before compression and after compression. The compressor further has another refrigerant circuit for a refrigerant gas after compression, i.e., the refrigerant circuit portion on discharge side interconnecting the front and rear discharge chambers 23, denoted at **23*a*** in FIG. 1. It should be noted that the same reference numerals as those in FIG. 6 denote elements and parts of the swash plate type compressor which have the same or like construction and operation as those of the compressor of the prior art.

The compressor of the first embodiment is different from that of the prior art in that the front housing 5 has a shaft sealing chamber 24 provided not only for preventing dust and foreign matter from intruding inside of the compressor when the compressor is mounted in an engine compartment of a vehicle or a motor car, but also for functioning as an intermediate pressure chamber as described later. The shaft 9 extends over an outer end of the front housing 5 through the shaft sealing chamber 24 and enclosed by conventional seals **24*a***.

As best shown in FIG. 1, the oil chamber 16 is filled with a lubricating oil in such a manner that a considerable amount of the lubricating oil overflows the oil chamber 16 and enters a lower part of the swash plate chamber 8, to cause an immersion of a peripheral part of the swash plate 10 into the oil in the swash plate chamber 8.

The shaft sealing chamber 24 of the front housing 5 is centrally arranged as an independent chamber having an appreciable volume and separated from the suction chamber 21 of the front housing 5 by an annular partition wall 25. The front valve plate 3 intervened between the front cylinder block 1 and the front housing 5 is provided with small through-holes 26 and 27 formed therein, and piercing thin valve sheets attached to both faces of the valve plate 3; the former through-hole 26 opening to the shaft sealing chamber 24 and the latter through-hole 27 opening to the suction chamber 21 of the front housing 5. These small through-holes 26 and 27 of the valve plate 3 are fluidly interconnected with one another by a radial shallow groove 28 (see FIG. 2) formed in an end face of the front cylinder block 1. The radial groove 28 per se is formed as an appreciably small fluid passageway having a small sectional area, and extending between the end face of the cylinder block 1 and the valve plate 3. The two through-holes 26 and 27 of the valve plate 3 and the groove 28 of the front cylinder block 1 establish a fluid communication between the shaft sealing chamber 24 and the suction chambers 21, i.e., the refrigerant circuit portion on the suction side.

The shaft sealing chamber 24 is also communicated with the swash plate chamber 8 through small gaps in the front radial bearing 22, and the shaft bore **1*a* of the cylinder block 1. It should be noted that the suction chamber 21 of the rear housing 6 is also communicated with the swash plate chamber 8 by not illustrated small passageways, to provide a pressure balance between the swash plate chamber 8 and the suction chamber 21 of the rear housing 6**.

When the swash plate type compressor is driven by a drive source, i.e., a vehicle engine and an appropriate rotation transmitting device, the drive shaft 9 is rotated, and therefore, the swash plate 10 rotating with the drive shaft 9 stirs the lubricating oil in the swash plate chamber 8. As a result, the lubricating oil is dispersed and lubricates the thrust bearings 11, and the shoes 14. A part of the lubricating oil also lubricates the radial bearings 22.

While the compressor is running, leakage of the compressed refrigerant gas from respective cylinder bores 12 into the swash plate chamber 8 through between the walls of respective cylinder bores 12 and the outer circumference of the reciprocating pistons 13 occurs, and therefore a pressure level in the swash plate chamber 8 is gradually increased. The refrigerant gas leaking into the swash plate chamber 8 then flows out of the chamber 8 toward the refrigerant circuit on the suction side, i.e., the suction chambers 21. At this stage, the shaft sealing chamber 24 functions as an intermediate pressure region existing between the swash plate chamber 8 having a high pressure and the suction chamber 21 of the front housing 5 having a low suction pressure. Namely, the shaft sealing chamber 24 can act as a buffering chamber to prevent a direct flow of the high pressure refrigerant gas from the swash plate chamber 8 into the suction chambers 21. Accordingly, even when the drive shaft 9 and the swash plate 10 are rotated at a high speed exceeding 5,000 r.p.m, while increasing a pressure level in the swash plate chamber 8, the existence of the shaft sealing chamber 24 communicated with both the swash plate chamber 8 and the suction chambers 21 prevents a generation of a large pressure differential between the swash plate chamber 8 and the shaft sealing chamber 24, and between the shaft sealing chamber 24 and the suction chamber 24. Therefore, a flow of the compressed refrigerant gas from the swash plate chamber 8 toward the suction chambers 21 is suppressed, and accordingly, an amount of lubricating oil carried by the flow of the compressed refrigerant gas is limited to a small amount. Further, an entire length of a fluid passageway from the swash plate chamber 8 to the suction chamber 21 of the front housing 5 via the shaft sealing chamber 24, the though-holes 26 and 27, and the groove 28 of the front cylinder block 1 is long enough to limit evacuation of the lubricating oil from the swash plate chamber 8 toward the suction chamber 21 of the front housing 5, and accordingly, a wet condition of the swash plate chamber 8 can be constantly maintained even when the compressor is run at a high speed. Also, the shaft sealing chamber 24 can function as an oil reservoir to receive the lubricating oil therein, and therefore, some of the oil received by the shaft sealing chamber 24 is returned to the swash plate chamber 8. As a result, the swash plate chamber 8 is always filled with a sufficient amount of lubricating oil from a low speed running condition to a high speed running condition of the compressor, and therefore, the internal movable elements of the compressor such as the thrust bearings 11, the shoes 14, the swash plate 10, and the radial bearings 22 are constantly lubricated by the lubricating oil in the swash plate chamber 8. It should be appreciated that, according to the first embodiment of the present invention, the compressor can rotate at a high speed of up to 9,000 r.p.m while maintaining a fully lubricated condition of the internal movable elements.

Figure 3:
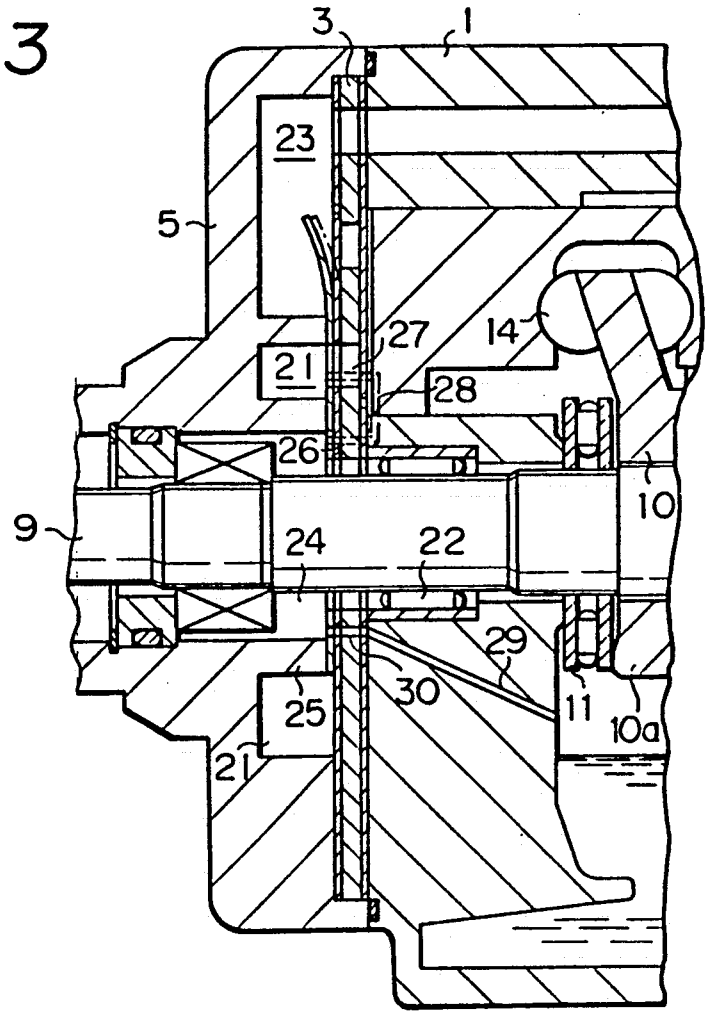
FIG. 3 is a partial cross sectional view of a swash plate type compressor provided with a internal movable element lubricator according to a second embodiment of the present invention.

Referring to FIG. 3 illustrating the second embodiment of the present invention, the swash plate type compressor of this embodiment is different from that of the above-mentioned first embodiment in that passageways 29 and 30 are additionally provided for promoting a return of the lubricating oil from the shaft sealing chamber 24 to the swash plate chamber 8. The passageway 30 opening to the shaft sealing chamber 24 at one end thereof is formed in the front valve plate 3 in addition to the afore-mentioned small through-holes 26 and 27, and the other opening end of the passageway 30 is connected to the passageway 29 in the form of a downwardly slanting through-bore from the shaft sealing chamber 24 toward the swash plate chamber 8 is formed in the front cylinder block 1. It should be noted that the through-holes 26 and 27 and the groove 28 are arranged separately from the passageways 29 and 30 and located at an upper position with respect to the center of the body of the compressor, compared with the location of the first embodiment. Since the swash plate type compressor is mounted in the vehicle engine compartment at a state where the drive shaft 9 is substantially in a horizontal position, the downward slant of the passageway 29 makes it easier for the lubricating oil in the shaft sealing chamber 24 to return to the swash plate chamber 8. As a result, an evacuation of the lubricating oil from the swash plate chamber 8 toward the suction chambers 21 is further suppressed, compared with the first embodiment, and accordingly, delivery of the lubricating oil with the compressed refrigerant gas from the compressor to an air-conditioning circuit can be completely prevented.

Figure 5:
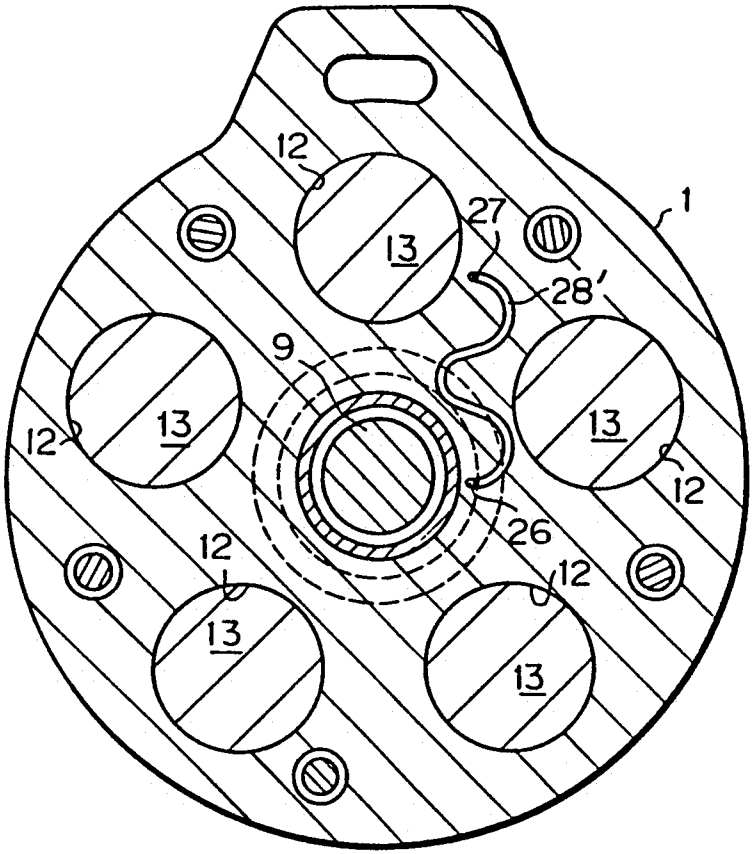
FIG. 5 is a cross-sectional view taken along the line V—V of FIG. 4.
Figure 4:
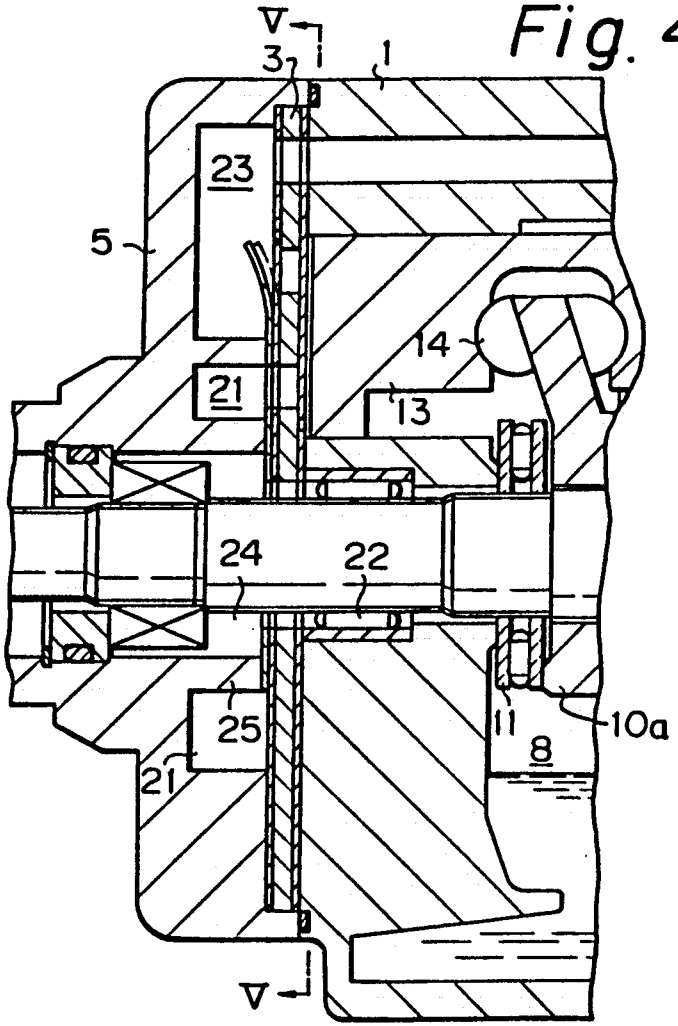
FIG. 4 is a cross sectional view similar to FIG. 3, illustrating a modified embodiment of the present invention.

The present invention is not limited to the first and second embodiments illustrated in FIGS. 1 through 3, and may be embodied in such a manner as illustrated in FIGS. 4 and 5, in which the shaft sealing chamber 24 and the suction chamber 21 of the front housing 5 is fluidly communicated by a sinuously extending groove 28′ (see FIG. 5) intended to establish an appreciably lengthened fluid passageway between both chambers 21 and 24. In the embodiment of FIGS. 4 and 5, the small through-holes 26 and 27 and the sinuous groove 28′ are generally located at an upper portion of the center of the compressor, as can be understood from a comparison of the illustrations of FIGS. 2 and 5.

In the embodiment of FIGS. 4 and 5, due to the arrangement of the fluid passageway including the sinuously extended groove 28′, when the lubricating oil is carried by the compressed refrigerant gas from the shaft sealing chamber 24 to the suction chamber 21, the lubricating oil adheres to the surface of the sinuous groove 28′. The adhered oil is gradually returned to the shaft sealing chamber 24 through the groove 28′ and the through-hole 26 due to the force of gravity acting on the lubricating oil adhered to the groove surface, and is eventually retained in the shaft sealing chamber 24. Therefore, an evacuation of the lubricating oil from the swash plate chamber 8 to the refrigerant circuit on the suction side can be fully suppressed.

In a further modification, a fluid communication may be arranged between the shaft sealing chamber 24 and a part of the refrigerant circuit on the suction side other than the suction chamber 21 of the front housing 5. Moreover, the swash plate chamber 8 and the shaft sealing chamber 24 may be fluidly connected by an appropriate passage formed in the cylinder block 1, in addition to the small gaps of the front radial bearing 22.

Further, the present invention may be applied to a swash plate type compressor employing an oil pump for supplying the lubricating oil to the thrust bearings 11 and the shoes 14.

From the foregoing description of the embodiments it will be understood that, according to the present invention, since the swash plate chamber of a swash plate type compressor is fluidly communicated with the refrigerant circuit on the suction side via the shaft sealing chamber, a high pressure prevailing in the swash plate chamber during the high speed running of the compressor is indirectly transmitted to the refrigerant circuit on the suction side. Therefore, a change in a pressure differential between the swash plate chamber and the shaft sealing chamber, as well as a change in a pressure differential between the shaft sealing chamber and the refrigerant circuit on the suction side, can be kept small. Therefore, the lubricating oil cannot be easily carried by the refrigerant gas from the swash plate chamber to the refrigerant circuit on the suction side, and thus the swash plate chamber is always filled with the lubricating oil to ensure a constant lubrication of the internal movable elements of the compressor. Also, the delivery of the lubricating oil toward an air-conditioning circuit is prevented, and therefore, any adverse affect on the air-conditioning circuit can be prevented.

Further, since the fluid passageway between the swash plate chamber and the refrigerant circuit on the suction side is appreciably long, the above-mentioned prevention of the carrying of the lubricating oil toward the refrigerant circuit on the suction side is further ensured. The provision of the shaft sealing chamber of the front housing, which functions as an intermediate pressure chamber, structurally separated from the swash plate chamber and the suction chambers, contributes to a reserving of the lubricating oil therein, to thereby lubricate the sealing element. When the lubricating oil is reserved in the shaft sealing chamber, some of the reserved oil is returned to the swash plate chamber, and therefore, the swash plate chamber is filled with the lubricating oil even when the compressor runs at a high speed, such as at 9,000 r.p.m. This also contributes to a reduction in the size of the oil chamber located beneath the swash plate chamber, whereby the entire size of the compressor can be reduced compared with the prior art swash plate type compressor.

We claim:

1. A swash plate type refrigerant gas compressor incorporated in an air-conditioning circuit for a vehicle and having a pair of axially combined front and rear cylinder blocks having a plurality of cylinder bores formed therein, an axially extended bore for rotatably receiving a drive shaft via radial bearings seated in said axial bore, a swash plate chamber, and an oil chamber for storing a lubricating oil, said swash plate chamber and said oil chamber being interconnected with one another to permit the lubricating oil to enter said swash plate chamber;

a swash plate received in said swash plate chamber and keyed on said drive shaft and capable of rotating with said drive shaft and stirring the lubricating oil in said swash plate chamber;

a front housing arranged at one axial end of the combined cylinder blocks via a front valve plate, and having therein a central shaft sealing chamber through which said drive shaft extends, a front suction chamber for a refrigerant gas before compression, and a front discharge chamber for the refrigerant gas after compression, said shaft sealing chamber being fluidly interconnected with said swash plate chamber via gaps in said radial bearings in said axial bore of said combined cylinder block;

a rear housing arranged at the other axial end of the combined cylinder blocks via a rear valve plate, and having therein a rear suction chamber for the refrigerant gas before compression, and a discharge chamber for the refrigerant gas after compression, said rear suction chamber being fluidly interconnected to said front suction chamber, and said rear discharge chamber being fluidly interconnected to said front discharge chamber, a plurality of reciprocatory double-headed pistons slidably fitted in said cylinder bores and operatively engaged with said swash plate via shoes for carrying out a suction and compression of the refrigerant gas in said cylinder bores, and a discharge of the compressed refrigerant gas from said cylinder bores to said discharge chambers of said front and rear housings, said pistons sliding across said swash plate chamber to thereby cause a leakage of a part of the compressed refrigerant gas from said cylinder bores into said swash plate chamber while said drive shaft and swash plate are rotating, said leakage of a part of the compressed refrigerant gas generating a high pressure condition in said swash plate chamber;

a pair of thrust bearings mounted on said drive shaft for axially supporting said swash plate against a thrust force acting on said swash plate;

a suction refrigerant circuit for permitting the refrigerant gas before compression to flow toward said cylinder bores when said refrigerant gas before compression is returned from the air-conditioning circuit, said suction refrigerant gas circuit including at least said front and rear suction chambers, said cylinder bores, and a passageway interconnecting said front and rear suction chambers;

lubricating means for limiting an evacuation of the lubricating oil from said swash plate ad oil chambers to said suction refrigerant circuit during said high pressure condition in said swash plate chamber, to thereby promote a lubrication of movable elements including at least said thrust bearings, said shoes, and said swash plate by the lubricating oil stored in said swash plate and oil chambers when said swash plate rotates and disperses said lubricating oil toward said movable elements, said lubricating means including:

a partition wall formed in said front housing for structurally separating said shaft sealing chamber from said suction chamber of said front housing; and a fluid passageway means arranged between said shaft sealing chamber and said suction chamber of said front housing for flow of said gas from said swash plate chamber to said suction chamber of said front housing through said shaft sealing chamber while said drive shaft and said swash plate were rotating, to thereby define a pressure in said shaft sealing chamber, intermediate between the pressure in the swash plate chamber and the pressure in the suction chamber, during the operation of the swash plate type compressor, said intermediate pressure in said shaft sealing chamber permitting separation of the lubricating oil from the gas when said lubricating oil is carried by said flow of the gas from the swash plate chamber to the suction chamber to thereby limit the loss of the lubricating oil from said swash plate chamber.

2. A swash plate compressor according to claim 1, wherein said fluid passageway means of said lubricating means comprises:

a first thin through-hole formed in said front valve plate, said first thin through-hole opening at one end thereof to said shaft sealing chamber;

a second thin through-hole formed in said front valve plate, said second thin through-hole opening at one end thereof to said suction chamber of said front housing; and a shallow groove formed in an axial end of said front cylinder block, said shallow groove providing an interconnection between said first and said second thin through-holes.

3. A swash plate compressor according to claim 2, wherein said shallow groove formed in an axial end of said front cylinder block extends radially and linearly from said first thin through-hole and said second thin through-hole.

4. A swash plate compressor according to claim 2, wherein said shallow groove formed in an axial end of said front cylinder block extends sinuously from said first thin through-hole and said second thin through-hole.

5. A swash plate compressor according to claim 1, wherein said lubricating means further comprises a second passageway obliquely extending from said shaft sealing chamber toward said swash plate chamber.

* * * * *